US007298857B2

(12) United States Patent
Shennib et al.

(10) Patent No.: US 7,298,857 B2
(45) Date of Patent: Nov. 20, 2007

(54) EXTENDED WEAR CANAL DEVICE WITH COMMON MICROPHONE-BATTERY AIR CAVITY

(75) Inventors: Adnan Shennib, Fremont, CA (US); Ian Michael Day, Fremont, CA (US); Timothy Cuongdung Huynh, San Jose, CA (US); Alex Tilson, Burlingame, CA (US)

(73) Assignee: Insound Medical, Inc., Newark, CA (US)

( * ) Notice: Subject to any disclaimer, the term of this patent is extended or adjusted under 35 U.S.C. 154(b) by 476 days.

(21) Appl. No.: 11/053,656

(22) Filed: Feb. 7, 2005

(65) Prior Publication Data

US 2005/0190938 A1 Sep. 1, 2005

Related U.S. Application Data

(60) Provisional application No. 60/542,776, filed on Feb. 5, 2004.

(51) Int. Cl.
*H04R 25/00* (2006.01)

(52) U.S. Cl. ..... 381/324; 381/328; 381/322; 181/130; 181/135

(58) Field of Classification Search ..... 381/312, 381/322, 323, 324, 328; 181/130, 135
See application file for complete search history.

(56) References Cited

U.S. PATENT DOCUMENTS

| | | | | |
|---|---|---|---|---|
| 4,817,609 | A | 4/1989 | Perkins et al. | |
| 5,401,920 | A | 3/1995 | Oliveira | |
| 6,137,889 | A | 10/2000 | Shennib et al. | |
| 6,208,741 | B1 * | 3/2001 | Shennib et al. | 381/323 |
| 6,212,283 | B1 | 4/2001 | Fletcher et al. | |
| 6,473,513 | B1 | 10/2002 | Shennib et al. | |
| 6,940,988 | B1 | 9/2005 | Shennib et al. | |
| 2005/0259840 | A1 * | 11/2005 | Gable et al. | 381/323 |
| 2005/0286731 | A1 * | 12/2005 | Shennib et al. | 381/322 |
| 2006/0050914 | A1 * | 3/2006 | Urso et al. | 381/328 |
| 2006/0215862 | A1 * | 9/2006 | Huynh et al. | 381/324 |

OTHER PUBLICATIONS

Ballachanda, The Human Ear Canal, Singular Publishing, 1995, pp. 195.

* cited by examiner

*Primary Examiner*—Curtis Kuntz
*Assistant Examiner*—Phylesha L Dabney
(74) *Attorney, Agent, or Firm*—Townsend and Townsend and Crew LLP

(57) ABSTRACT

An embodiment provides a continuous wear hearing device to be worn entirely within the ear canal, comprising a receiver assembly sized to be positioned in the bony portion of the canal, a battery assembly and a microphone assembly. The receiver assembly includes a receiver for supplying acoustic signals to the tympanic membrane. The battery assembly is coupled to the receiver assembly and includes a metal-air battery and a battery vent. The microphone assembly is coupled to the battery assembly and includes a microphone and a microphone sound port. The sound port faces a medial direction with respect to the canal. The orientation and position of the microphone in the canal are configured to reduce fouling of the port by cerumen. The positioning of the microphone assembly defines an air cavity disposed between the microphone assembly and the battery assembly with the port and the vent fluidically coupled to the cavity.

24 Claims, 6 Drawing Sheets

EXTENDED WEAR CANAL DEVICE WITH COMMON MICROPHONE-BATTERY AIR CAVITY

CROSS-REFERENCES TO RELATED APPLICATIONS

This application claims the benefit of priority of U.S. Provisional Application Ser. No. 60/542,776, filed on Feb. 5, 2004, the full disclosure of both of which is incorporated herein by reference. The application is related to the following: commonly-assigned patent U.S. Pat. No. 6,473,513 issued Oct. 29, 2002; commonly-assigned and co-pending applications for patent: U.S. patent application Ser. No. 09/199,669 filed Nov. 25, 1998; U.S. patent application Ser. No. 11/044,493 filed Jan. 26, 2005; and the following commonly-assigned applications: U.S. patent application Ser. No. 11/053,174 filed Feb. 7, 2005; and U.S. patent application Ser. No. 11/058,197 filed Feb. 14, 2005.

BACKGROUND OF THE INVENTION

FIELD OF THE INVENTION

Embodiments of the invention relates to extended wearing hearing devices. More particularly, embodiments relate to extended wear CIC hearing aids having contaminant resistant microphone assemblies. Embodiments also relate to extended wearing CIC hearing aids having an air cavity that provides an air reservoir for operation of the hearing aid battery when the ear canal is obstructed.

Since many hearing aid devices are adapted to be fit into the ear canal, a brief description of the anatomy of the ear canal will now be presented for purposes of illustration. While the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, chewing, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal. Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

First generation hearing devices were primarily of the Behind-The-Ear (BTE) type. However they have been largely replaced by In-The-Canal (ITC) hearing devices are of which there are three types. In-The-Ear (ITE) devices rest primarily in the concha of the ear and have the disadvantages of being fairly conspicuous to a bystander and relatively bulky to wear. Smaller ITC devices fit partially in the concha and partially in the ear canal and are less visible but still leave a substantial portion of the hearing device exposed.

Recently, Completely-In-The-Canal (CIC) hearing devices have come into greater use. These devices fit deep within the ear canal and can be essentially hidden from view from the outside. In addition to the obvious cosmetic advantages, CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

However despite their advantages, the microphones and other components of current CIC hearing aids frequently become fouled with cerumen and other contaminants. This results in part from the fact that current CIC devices position their microphone in an outwardly facing (e.g., laterally) direction in the cartilaginous portion of the ear canal where cerumen is produced and collects. When the user scratches their ear, the cerumen becomes pressed against and fouls the microphone. Manufactures position their microphones in a lateral direction with respect to the ear canal because of the view that placing the microphone in the opposite orientation (e.g., medially) would acoustically compromise the performance of the microphone and thus, the hearing aid. Also, hearing devices which utilize a metal air battery can fail if the air vent to the battery becomes fowled or the ear canal becomes obstructed preventing oxygen from reaching the battery, resulting in oxygen starvation of the battery. There is a need for a CIC hearing aid that is resistant to fouling of the microphone or battery vent and provides a means to prevent metal-air battery failure from obstruction of the ear canal.

BRIEF SUMMARY OF THE INVENTION

Embodiments of the invention provide an extended wear hearing device having long term reliability and resistance to contamination and damage when the device is worn completely in the ear canal (CIC) on a continuous basis. More particularly, embodiments provide an extended wear CIC hearing aid having a medial oriented microphone assembly that is resistant to fouling by cerumen and other ear canal debris as well as damage by objects inserted into the canal. Various embodiments also provide an extended wear CIC hearing aid having an air reservoir that can supply the oxygen requirements of a metal-air hearing aid battery for extended periods of time when the ear canal is obstructed by water or other debris.

One embodiment provides a continuous wear hearing device adapted to be worn entirely within an ear canal of a wearer comprising a receiver assembly sized to be positioned in the bony portion of the ear canal, a microphone assembly and a battery assembly. The receiver assembly includes a receiver for supplying acoustic signals to the tympanic membrane of the wearer. The receiver as well as the microphone assembly can include a sealing retainer to retain the hearing device in position in the ear canal as well as provide acoustical attenuation to prevent feedback.

The battery assembly is coupled to the receiver and includes a metal-air battery and a battery vent. In preferred embodiments, the battery is a zinc air battery, though in alternative embodiments, the battery can be a non metal air battery such as a lithium battery. The microphone assembly is coupled to the battery assembly and includes a microphone and a microphone sound port. The sound port substantially faces a medial direction with respect to the ear canal. The orientation and position of the microphone in the ear canal are configured to reduce fouling of the sound port by cerumen and other contaminants such as oil, hair dirt etc. The microphone assembly is also positioned so as to define an air cavity that is disposed between the microphone assembly and the battery assembly and the microphone sound port and the battery vent are fluidically coupled to the air cavity. Also one or both of the microphone assembly and the battery assembly can be at least partially contained in or other wise coupled to a housing, which can include at least one port for air access to the cavity.

In many embodiments, the microphone sound port and the battery vent are in a spatially facing relation with respect to the cavity. However in alternative embodiments, these two features can be facing away from each other or positioned at a selectable angle. Typically, the cavity will include one or more ports or entrances (e.g., formed by the battery or microphone assemblies) through which sound waves and air can enter. The cavity can be configured such that an acoustical conductance pathway through a cavity port to the microphone sound port is substantially perpendicular to the longitudinal axis of hearing device. This can be accomplished in one embodiment by placing the ports on one or more sides of the cavity.

In various embodiments, the cavity is configured to provide an air reservoir to the meet the oxygen requirements of the battery to power the hearing device when the ear canal is fully obstructed by fluid or other matter (e.g., during swimming or showering). In specific embodiments, the cavity can be configured to provide an air reservoir to meet the oxygen demand of the battery for up to two hours or even longer. The cavity can also be configured to reduce the influx of cerumen to one or both of the sound port or the battery vent, for example, through the use of small port sizes or configuring the cavity to have a narrow depth. In a related embodiment, the cavity can be protected by a circumferential membrane which sound and air access into the cavity, but protect against the entrance of liquid water, cerumen and other contaminants.

Another embodiment provides a continuous wear hearing device adapted to be worn entirely within an ear canal of a wearer comprising a receiver assembly sized to be positioned in the bony portion of the ear canal, a battery assembly and a microphone assembly. The receiver assembly includes a receiver for supplying acoustic signals to a tympanic membrane of the wearer. The battery assembly is coupled to the receiver and includes a metal-air or other battery and a battery vent. The microphone assembly is coupled to the battery assembly and includes a microphone and a microphone sound port where the microphone sound port faces a medial direction with respect to the ear canal. The orientation and position of the microphone in the ear canal are configured to reduce fouling of the sound port by cerumen and protect the microphone against damage from objects inserted into the ear canal such as insertion or removal fixtures, washcloths, Q-tips®, etc. Also, the medial configuration of the microphone allows for the attachment of insertion and/or removal fixtures to the microphone assembly which do not interfere with the conduction of sound to the sound port. Further, this configuration allows the microphone to function similar to a parabolic microphone by being positioned in a location and orientation in the ear (e.g., in the cartilaginous portion of the canal, medially facing) to take advantage of the acoustical focusing qualities of the ear morphology to focus sound on the microphone. The focusing effect can enhanced through the use of a curved sealing retainer positioned around the microphone which reflects sound back to medially facing microphone. These focusing effect results in improved sensitivity and a flatter frequency response over the audio range of sound frequencies (e.g., 250 to 6000 Hz).

In an exemplary embodiment of a method for using a hearing device having a parabolic microphone, the hearing device is inserted into the ear of the user with the microphone positioned in the cartilaginous portion of the ear canal with microphone sound port facing a medial direction. The acoustical focusing effects of the morphology of the ear are then utilized to focus or otherwise direct incoming sound waves on or near the sound port of the microphone. The signals are then processed by the device and converted by the device receiver to acoustical output signals which are supplied to the tympanic membrane. The focusing effects can be enhanced by adjusting the position of the device in the ear canal while the user listens to a test signal or even ambient sound and then notes what position results in better quality sound (e.g., clearer, etc).

BRIEF DESCRIPTION OF THE DRAWINGS

FIG. 6 is an enlarged view of the microphone and battery assemblies of the hearing device of FIG. 5 showing the relative positions of the sound port of the microphone and the air port of the battery within the common volume there between.

DETAILED DESCRIPTION OF THE INVENTION

Figure 1:
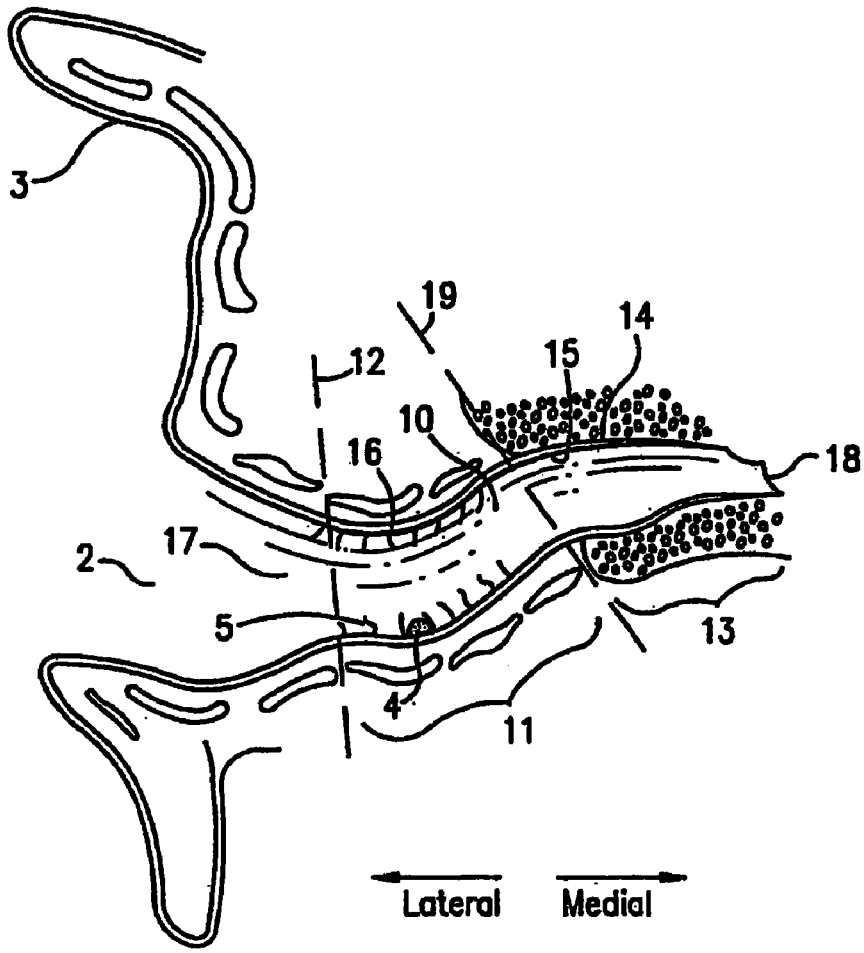
FIG. 1 is a side coronal view of the external ear canal.
Figure 2:
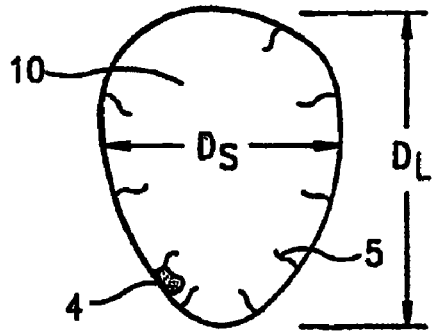
FIG. 2 is a cross-sectional view of the ear canal in the cartilaginous region.

Embodiments of the invention provide an extended wear hearing device having long term reliability and resistance to contamination when the device is worn completely in the ear canal (CIC) on a continuous basis. More particularly, embodiments provide an extended wear CIC hearing aid having a medial oriented microphone assembly that is resistant to fouling by cerumen and other ear canal debris as well as damage by objects inserted into the canal allowing the device to be worn for extended periods of time without removal for cleaning, battery replacement or other maintenance. In this context, extended wear is understood to refer to wear continuously (or near continuously) on the order of several months or longer. In specific embodiments, embodiments of the invention provide an extended wear hearing device that can be worn continuously for 3 months, 6 months or even longer. These durations can be achieved through the use of high capacity zinc-air batteries, low power circuitry (e.g., for the microphone and speaker) and cerumen/contaminant resistant designs such as the medial oriented microphone. Various embodiments also provide a extended wear CIC hearing aid having an air reservoir that can supply the oxygen requirements of a metal-air hearing aid battery for several hours or longer when the ear canal is obstructed by water or other debris.

Referring now to FIGS. 3-6, an embodiment of a CIC hearing aid device 38 configured for placement and use in ear canal 10 can include a receiver (or speaker) assembly 32, a microphone assembly 42 and a battery assembly 52. Preferably, device 38 is configured for placement and use in or near the bony region 13 of canal 10 so as to minimize acoustical occlusion effects due to residual volume of air in the ear canal between device 20 and tympanic membrane 18. For example, in the embodiment shown in FIG. 3, device 38 is positioned medially from bony junction 34. The occlusion effects are inversely proportion to residual volume 6; therefore, they can be minimized by placement of device 20 in the bony region 13 so as to minimize volume 6.

Receiver assembly 32 is configured to supply acoustical signals received from the microphone assembly to a tympanic membrane of the wearer of the device. The microphone assembly 42 includes a microphone 40 and microphone sound port 44 through which sound waves enter the microphone. The microphone is configured to receive incoming acoustic signals. One or both of the receiver assembly or microphone assembly can include sealing retainers 33 and 43 described herein. Battery assembly 52 and speaker assembly 32 can be coupled by a coupling 36, which can include a flexible coupling **36*f* discussed herein. In alternative embodiments coupling 36, 36*f* can be configured to join speaker assembly 32 and microphone assembly 42 (See FIG. 5**).

Battery assembly 52 includes a battery 50 configured to provide power to hearing device 38 for an extended periods of operation and is thus, desirably a high capacity battery. In many embodiments battery 50 is a metal air battery which has an electrochemistry that utilizes oxygen to generate electricity. Accordingly, in such embodiments, battery assembly 52 can include a battery vent 54 though which air including oxygen can enter the battery. Example metal air batteries include, but are not limited to, aluminum, calcium, iron, lithium, magnesium-air based battery. In a preferred embodiment, battery 50 is a zinc-air battery known in the art. In alternative embodiments, battery 50 can employ a variety of electrochemistry known in the art including, but not limited to, lithium, lithium polymer, lithium ion, nickel cadmium, nickel metal hydride, or lead acid or combinations thereof.

In many embodiments, the microphone assembly 42 is coupled or otherwise positioned with respect to a battery assembly 52 to form a cavity or air volume 60 that is disposed between the microphone assembly 42 and battery assembly 52. Both sound port 44 and battery vent 54 are desirably fluidically coupled to cavity 60. That is they are fluidically coupled to the air in cavity 60 such that air entering the cavity can reach both the sound port 44 and battery vent 54. This allows sound waves to reach the sound port and oxygen to reach the battery vent. Cavity 60 includes cavity openings or ports 61 though which air including sound waves can enter the cavity and reach sound port 44 and battery vent 54. The use of cavity 60, allows the microphone assembly and battery assembly to be placed in any number of orientations and still have the sound port and battery vent fluidically coupled to the cavity. For example, they can be facing each other or even positioned orthogonally.

Cavity 60 can be configured to perform several functions, first as discussed above, cavity 60 can serve as a conduit for supplying air to the battery vent 54 and conducting sound to microphone port 44. The cavity can also be configured to provide an air reservoir **60*r* to the meet the oxygen requirements of a metal air battery 50 in powering the hearing device 38 for an extended period of operation. This allows device 38 to continue normal operation (e.g., no appreciable loss in volume or frequency response) when the ear canal is partially or even fully obstructed by fluid, cerumen or other matter resulting from activities such as bathing, swimming or merely through long term wear. Reservoir 60*r* also extends the life of the battery by preventing the battery from becoming oxygen starved which can damage battery components (e.g., the anode, cathode, etc) or otherwise compromise battery performance. In specific embodiments, the volume of the cavity can be configured to provide an air reservoir to meet the oxygen demand of a metal air battery such as a zinc-air battery for up to two hours or even longer (e.g., three or four). Longer reserve times can be achieved with larger cavity volumes. Finally, the cavity can also be configured to reduce the ingress of cerumen to the microphone and battery assemblies (and thus fouling of the sound port and battery vent), by configuring the size of cavity port 61 and/or cavity spacing 60**D to prevent entry of cerumen and other contaminants. This results in improved, reliability and longevity of the hearing device by reducing the likely hood of failure or degraded performance of one or both of the microphone or battery from fouling by cerumen. In particular, embodiments having a common air cavity can prevent or reduce a phenomenon known as "gain slippage" also known as "roll-off." which can result from cerumen blockage of the microphone. Further improvement in reliability can be achieved through the use of a circumferential barrier system described herein.

In many embodiments in which the hearing device has an air cavity, the microphone assembly as well as the battery assembly can be housed or otherwise positioned in a lateral module 46, also known as housing 46. In one embodiment, module 46 comprises coupled microphone assemblies 42 and battery assemblies 52. Module 46 can include and also at least partially define cavity 60 disposed between the microphone assembly 42 and battery assembly 42. Module 46 also includes one or more module ports 47, configured to allow the entrance of air and sound waves into cavity 60. Ports 47 can also comprise cavity ports 61 or otherwise substantially be fluidically coupled to ports 61 to allow the entrance of air and sound waves from port 47, though ports 61 and into cavity 60. Ports 47 can have a variety of shapes and sizes including, without limitation, slot shaped, rectangular circular, oval and combination thereof. In many embodiments, ports 47, 61 can be positioned on the sides 46*s* of module 46 to allow side access of air and sound into the cavity and thus an acoustical conductive pathway that is perpendicular to the longitudinal axis 38L of hearing device 38 In one embodiment described herein, a portion of module 47 can comprise a cap 90 including a perforated cap 90 having one or more perforations 91 which can be configured as ports 47 to cavity 60.

Figure 4:
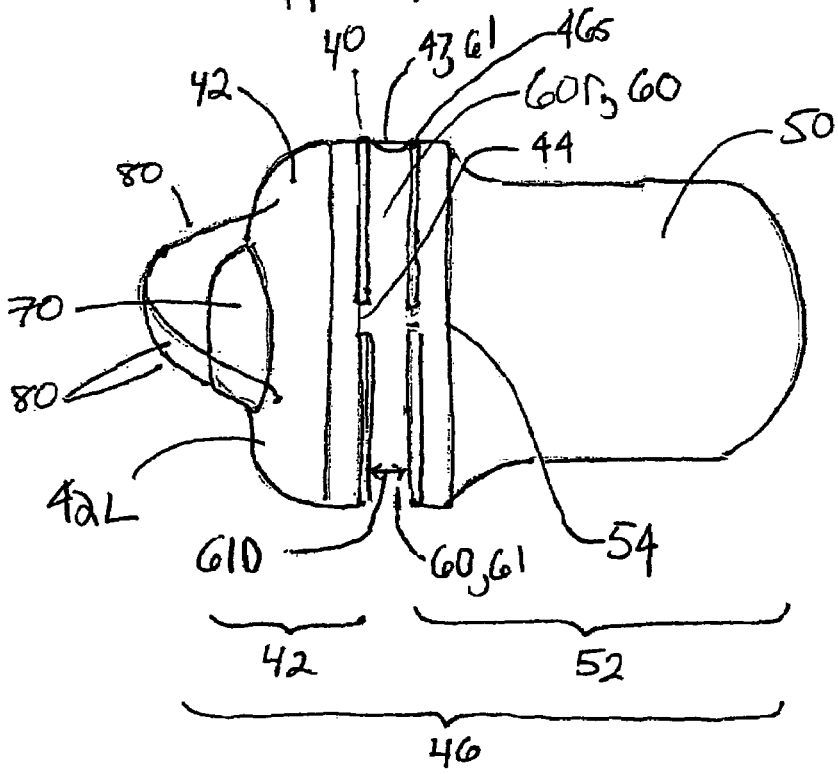
FIG. 4 is an enlarged view of the microphone and battery assemblies of the hearing device of FIG. 3 showing the relative positions of the sound port of the microphone and the air port of the battery within the common volume therebetween.
Figure 5:
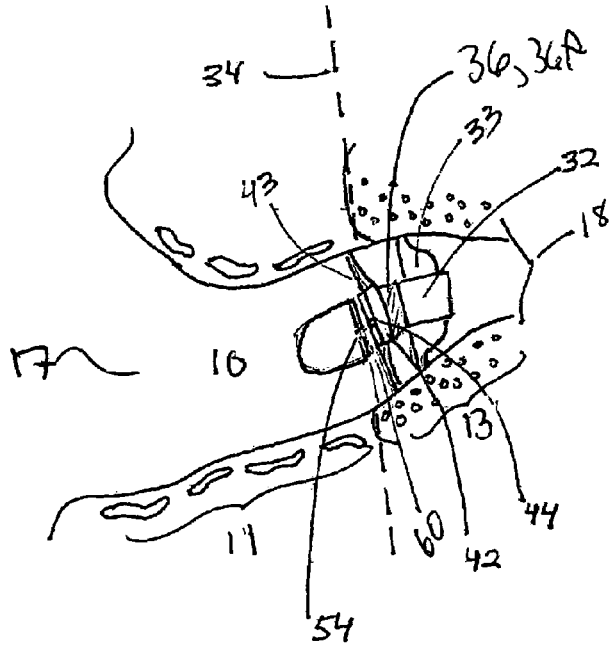
FIG. 5 is a side view of the ear canal showing an alternate embodiment of a hearing device according to the present invention located medially from the bony junction, in which apertures for the microphone and battery assemblies face each other within the same common volume.

In preferred embodiments, the sound port 44 of microphone assembly 42 can be positioned to face tympanic membrane 19, so as to have a medial orientation. FIG. 4 illustrates the relative positioning of microphone sound port 44 of microphone 40 of microphone assembly 42 with respect to battery vent 54 of battery assembly 52. For ease of illustration, FIG. 4 omits sealing retainers 33 and 43; however, both can be included in this embodiment shown. In the embodiment shown, microphone 40 of microphone assembly 42 are in a "reversed" position verses that in prior art designs in which the aperture of the microphone faces incoming sounds laterally i.e., away from the eardrum). The result is that battery vent 54 is positioned facing microphone sound port 44 with minimal spacing there between, such that battery vent 54 and microphone sound port 44 share common cavity 60. In these and related embodiments, access to microphone sound port 44 and battery vent 54 can be now achieved in a direction perpendicular to the longitudinal axis 381 of hearing device 38. Desirably, the spacing 60D between the microphone sound port and the battery assembly is sufficient to prevent acoustic reflections between the microphone assembly and battery assembly. In various embodiments, the spacing 60D can be can in the range of about 0.007 to about 0.015 inches with a specific embodiment of 0.010 inches.

The medial orientation of sound port together with its position in ear canal can be used to perform several functions which result in improved sound quality and/or reliability of embodiments of the hearing device. These include: i) reducing the ingress and fouling of the microphone with cerumen and contaminants; ii) protecting the microphone against damage from inserted objects; iii) allowing the microphone to be used/function as a parabolic microphone; iv) allowing the use of insertion and removal fixtures which do not interfere with sound reaching the microphone; v) allowing the use of more mechanically robust insertion and removal fixtures; and vi) allowing the use of additional insertion and removal fixture which facilitate insertion and removal of the device. Reduced fouling is achieved by placing the microphone in a position and orientation in which cerumen and other biological debris is less likely to contact and enter the microphone. Cerumen, cells and other biological debris is sloughed off the ear canal and migrates laterally collecting in the opening of the ear canal as is described herein. When the user scratches their ear, uses a Q-tip or presses against the hearing aid, this matter is pressed back into the ear canal and can be readily pressed against a laterally facing microphone fouling the microphone. However, when the microphone sound port is in the medial direction, compaction against the sound port is eliminated or significantly reduced. For similar reasons, the medial orientation of the microphone sound port also serves to protect the microphone from damage, caused by insertion of foreign, objects (e.g., Q-tips, fingers, etc.) or damage occurring during the insertion or removal of the hearing device using insertion or removal tools.

As described above, the medial orientation of sound port 44 can also be used to configure microphone 40 to function as a parabolic microphone 40*p*, by positioning the microphone in a location and orientation in the ear to take advantage of the acoustical focusing effects of the natural ear morphology to focus sound on or in the area of the microphone sound port. The desired focusing effects can be achieved by positioning the microphone can be positioned in the cartilaginous portion 11 of the canal, for example close to the body portion interface. In particular embodiments, acoustical measurements can be taken in the ear of individual users to determine an optimum position in the ear canal for maximum focusing effect and the shape and size of the housing 46 and device 38 can be modified accordingly. The focusing effect/parabolic microphone function can enhanced through the use of a curved sealing retainer positioned around the microphone assembly that reflects sound back to medially facing microphone as is discussed herein. These focusing effect results in improved hearing aid sensitivity and a flatter frequency response over the audio range of sound frequencies (e.g., 250 to 6000 Hz).

In various embodiments, housing 46 and/or microphone assembly 42 can include fixtures adapted for facilitating insertion or removal of device 38 from the ear canal. FIG. 4 shows an embodiment of device 38 including insertion tab 70 and removal loops 80 coupled to a the lateral end 42L of microphone assembly 42 in which sound port 44 is medial facing. Because of the medial orientation of sound port 44 these fixtures are thus positioned so as not to interfere with conductance of sound to sound port 44. Specifically, they can be displaced away from the sound port sufficiently so as not to, attenuate, dampen or otherwise interfere with conduction of sound waves to the port. The medial orientation of sound port 44 also allows fixtures 70 and 80 to be centrally located or otherwise evenly disposed on the microphone assembly so as to more evenly distribute the forces applied to assembly 42 dining insertion, facilitating insertion and removal and reducing risks of component failure. The medial orientation also allows the fixtures to be more mechanically robust in design, e.g., greater rigidity, strength, etc., also allowing for easier and safer insertion and removal of device 38. Also, other mechanical features or devices, including magnets and magnetic plates, cords, etc., as well as combinations of thereof can be used for removal or other functions (e.g., wireless communication to the hearing device) without interfering with sound transmission or the magnetic properties of the microphone. Thus in use, medially oriented microphone port 44 provides a means for improving the safety (e.g., improved reliability) and ease in inserting and removing the hearing device by the user or a medical practioner. Further description of removal fixtures, systems and related removal tools is found in con-currently filed U.S. patent application Ser. No. 11/053,174.

Figure 3:
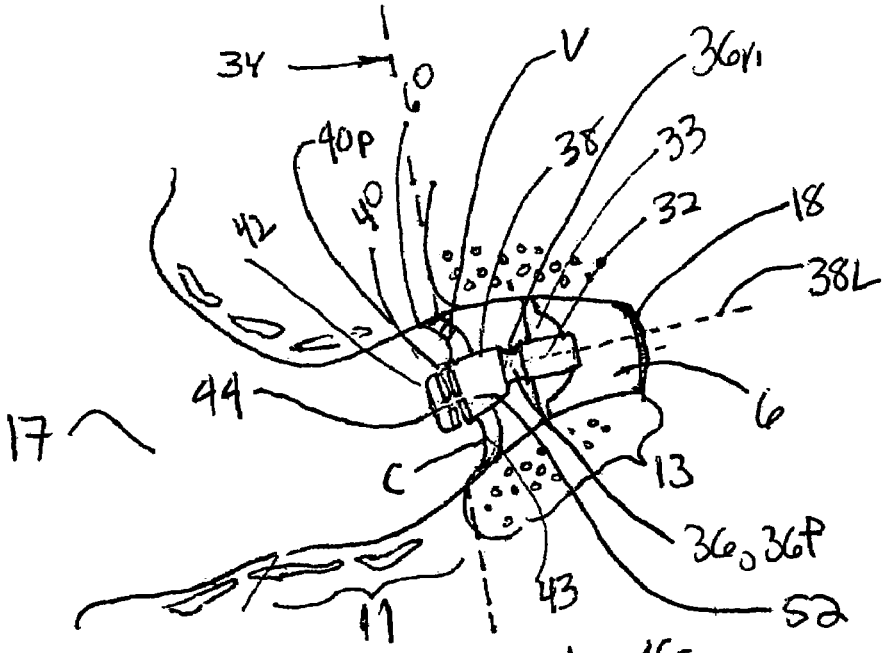
FIG. 3 is a lateral view of the ear canal illustrating an embodiment of a hearing aid device positioned in the bony portion of the ear canal, the device having apertures for the microphone and battery assemblies facing each other within a common air cavity.
Figure 6:
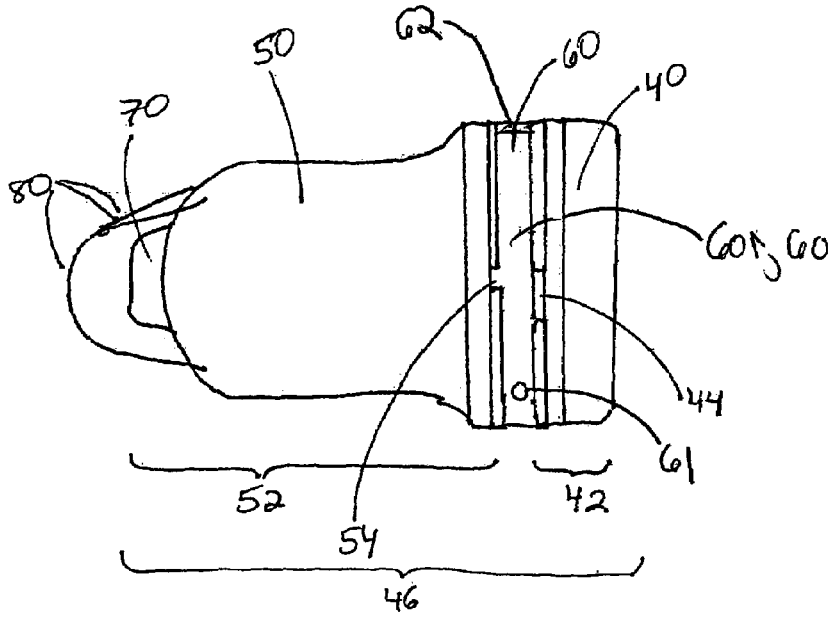

In various embodiments, battery assembly 52 and microphone assembly 42, including vent 54 and sound port 42, can have a number of configurations in addition to that shown in FIG. 3. In an alternate embodiment of a hearing device shown at 39 in FIG. 5, microphone assembly 42 and battery assembly 52 may be placed in juxtaposed positions with respect to one another as compared to their placement in the embodiment shown in FIG. 3. As illustrated in the FIG. 5, microphone assembly 42 may be positioned medially with respect to battery assembly 52 such that microphone assembly 42 is disposed between battery assembly 52 and receiver or speaker assembly 32. Sound port 44 and battery vent 54 still face one another with the volume in between microphone assembly 42 and battery assembly 52 forming medial cavity 60 and air reservoir 60*r* in FIG. 5. FIG. 6. shows the placement of the insertion tab 70 and removal loops 80 in the embodiment of hearing device 39. Again for ease of illustration, FIG. 6 omits sealing retainers 33 and 43; however, both can be included in this embodiment shown.

As described above, in various embodiments, one or both of the receiver or microphone assemblies can include sealing retainers. In one embodiment receiver assembly 32 can include a first sealing retainer 33 which can comprise a sealing retainer ring co-axially positioned around the speaker. Similarly, microphone assembly 42 can include a second sealing retainer 43 which can also be coaxially positioned around the microphone assembly. The sealing retainers can be configured to retain the device 38 in the ear canal as well as provide acoustical attenuation to prevent feedback. The retainers can also be tissue conformable to the shape of the ear canal. One or both seals can also be vented with a vent V.

Desirably, the retainers have a shape, size and mechanical property(s) to retain the hearing device in the ear canal during head movements (e.g., chewing, head rotation, etc). In preferred embodiments, one or both retainer has at least a partially hemispherical shape that is configured to have a curved profile C (concave outward in the lateral direction) when positioned in ear canal 10. The retainers can also be tissue conformable to at least partially conform to the shape of the canal. In one embodiment, the profile C of the microphone retainer 43 and/or speaker retainer can be substantially parabolic or otherwise shaped to focus or otherwise direct sound into the microphone sound port 44. This can be accomplished by directing the sound onto housing 46 including cavity ports 61.

In various embodiments, the retainers can be fabricated from biocompatible foam polymers or other conformable polymers known in the art which can also have selectable amounts of acoustical attenuation (e.g., 10 dB or greater). Suitable foam polymers include without limitation silicone, polyurethanes and co-polymer thereof. The foam material can also include antimicrobial compounds known in the art. Also, the retainers can include multiple layers including skin contacting layer, with a first set of properties and a second layers having a second set of properties. For example, the skin contacting layer can have a first elasticity or softness (e.g., approximating that of the canal epithelium 10 so as to be tissue conformable) and the second layer can have less elasticity and/or softness. The first layer can thus be a tissue conforming layer and the second layer a layer acting as a spring (e.g., a leaf spring) to hold the device in place in the ear by exerting a spring force against the canal walls.

As discussed above, in various embodiments, the coupling 36 between battery assembly 52 and the speaker assembly 32 can be a flexible coupling or joint 36*f*. Suitable flexible couplings 36*f* can include but are not limited to swivel joints, articulated joints, elastomeric or other flexible tubing and other flexible couplings known in the art. In a preferred embodiment, flexible joint 36*f* can comprise necked elastomeric tubing that fits over end portions of the battery and speaker assemblies. The necked portion 36*n*, can be achieved using a restricting O-ring 36*o* (see FIG. 7A) or using hot air necking techniques known in the medical tubing/catheter arts. In particular embodiments, flexible coupling 36*f* can be configured to limit the range of motion of battery assembly 42 with respect to the speaker assembly to keep the battery and receiver assemblies from jack-knifing in the ear canal. In various embodiments, flexible coupling can be configured to limit the range of motion to no more than 90° with specific embodiments of no more than 75, 60, 45 and 30°. Selected range of motions can be achieved by the use of mechanical stops which are integral or otherwise coupled to coupling 36*f*.

In some embodiments, hearing device 38 may also include a circumferential barrier system 62. Typically, the barrier system will comprise a membrane that is placed around a circumferential section of housing 46 that includes cavity ports 61. Barrier system 62 is configured to protect cavity 60 from liquid and debris entering the cavity while allowing sound and air access into the cavity and thus to sound port 44 and battery vent 54. Barrier system 62 can comprise a membrane that is preferably hydrophobic, oleophobic and cerumenophobic to prevent or minimize water, oils and cerumen from entering the cavity 60 and fouling the battery vent and sound port. The barrier system is also desirably acoustically transparent allowing the transmission of sound through the barrier system unencumbered and in a non-distorted manner. This combination of properties can be achieved in a single layer membrane or in a multilayer membrane where different layers have different properties. Suitable materials for barrier include fluoro-polymers including porous fluoro-polymers such as expanded PTFE membranes available from W. L. Gore & Associates (Flagstaff, Ariz.). Should the barrier become temporarily occluded by water or debris when the hearing device is worn for extended periods or during showering, swimming, etc. cavity 60 functions as an air reservoir 60*r* (described herein) for microphone 40 and battery 50 in order to maintain proper functioning of these components. Barrier 62 can also be configured to maintain the reservoir function of the cavity by preventing water or other fluid from flooding the cavity.

Figure 7A:
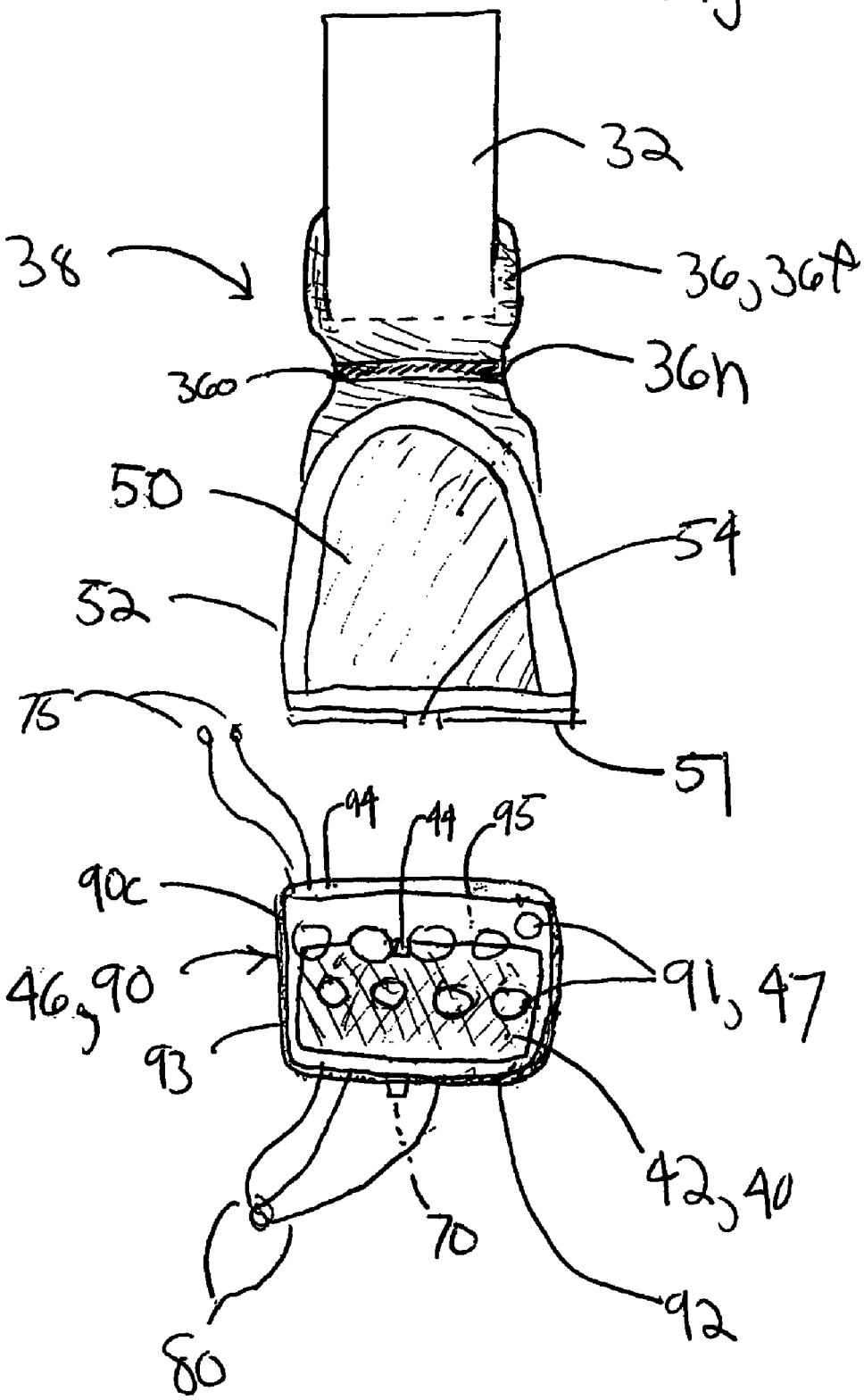
FIG. 7A is a side view illustrating the assembly of an embodiment of a cap assembly onto components of an embodiment of the extended wear hearing aid.
Figure 7B:
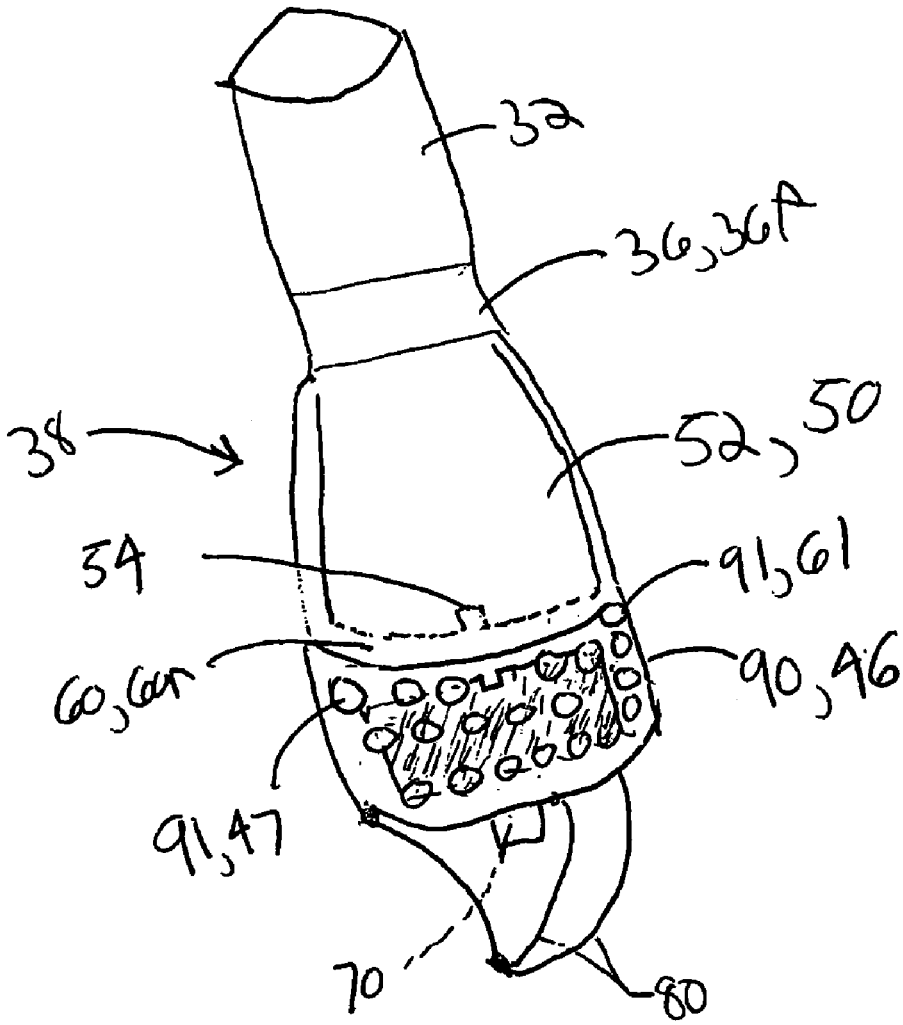
FIG. 7B is a perspective view illustrating the cap assembly of FIG. 7A assembled onto the extended wear hearing aid.
Figure 7C:
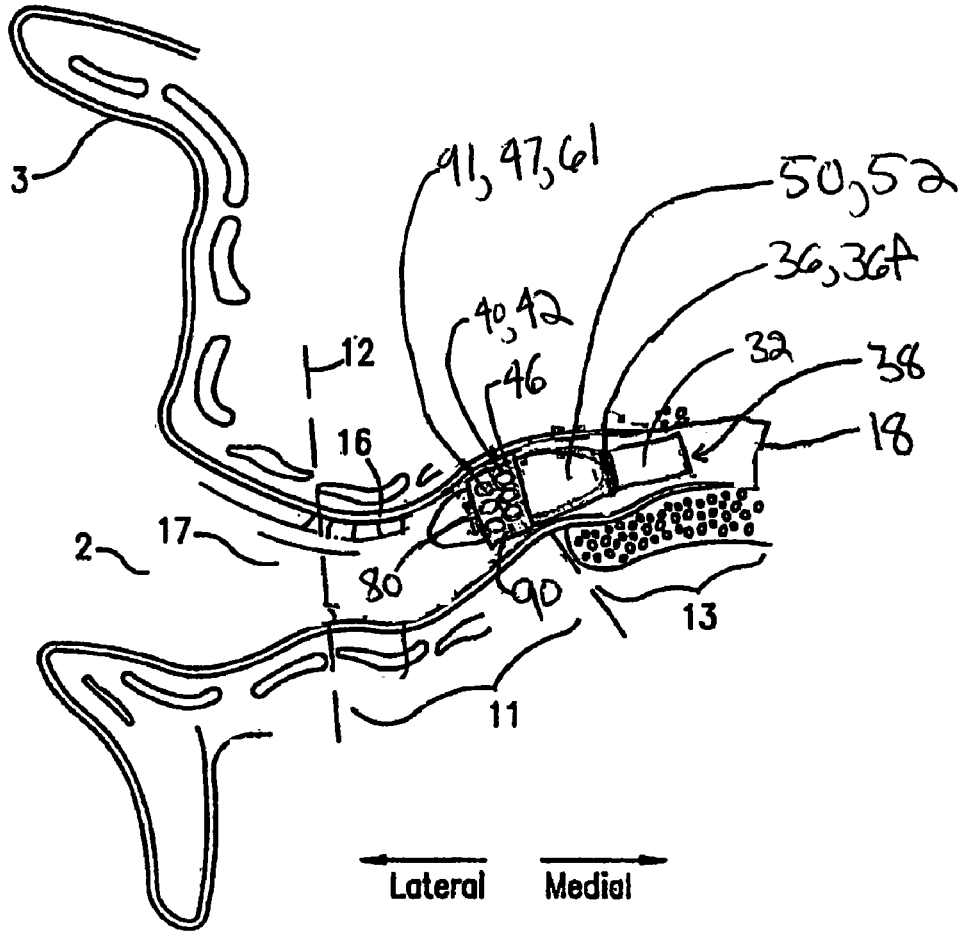
FIG. 7C is a lateral view illustrating an embodiment of a hearing aid device having a cap assembly positioned in the bony portion of the ear canal.

Referring now to FIGS. 7A-7C, a discussion will be presented of alternative embodiments of housing 46 in which all or portions of the housing comprise a protective cap 90. The cap is configured to be mounted over or otherwise coupled to at a lateral end 38L of hearing device 38. In many embodiments, the cap will be configured to mount over most or all of microphone assembly 42. However, the cap can also be configured to be mounted over portions of battery assembly 52 and even portions of receiver assembly 32. In a preferred embodiment, the cap is configured to mount over all of microphone assembly 42 and a portion of battery assembly 52. In particular embodiments, the cap can be configured to mounted over an even form a seal 51 with one or more components of battery assembly 52 such as battery 50.

The cap can have a variety of shapes including, but not limited to, cylindrical, semi-spherical and thimble shaped. In a preferred embodiment, the cap is substantially cylindrically shaped and includes a top portion 92 and a side wall portion 93 and an interior or cavity portion 95. Side wall portion 93 defines an open medial portion or opening 94 to cavity portion 95. In many embodiments, the cap include one or more perforations 91 which can be configured to serves as channels for ventilation for moisture reduction, oxygen supply to the battery, and acoustical conduction as is discussed herein. Perforations 91 can be positioned in various locations throughout the cap but are preferentially positioned in patterns on the top and sides of the cap. Also, all or portions of cap 90 can include a protective coating 90*c* which can be configured to be hydrophobic, oleophobic, and cerumenophobic to prevent or minimize water, oils and cerumen from entering the cavity 90.

In many embodiments, the cap interior 95 has a sufficient volume and shape to serve as a receptacle for various components of hearing aid 38 including, but not limited to, microphone assembly 42 and associated integrated circuit assemblies, battery assembly 52, receiver assembly 32 and electrical harnesses or connections 75 for one or more hearing aid components. After the component or components are placed within the cap interior 95, a setting or encapsulation material can be added. In a preferred embodiment, the cap is configured to serve as a receptacle to the microphone assembly when the microphone is oriented in a medial direction of the ear canal. In such embodiments, the cap is also configured to provided sufficient acoustical transmittance to the microphone assembly such that the hearing aid provides adequate function to the user (e.g., amplification, frequency response, etc). Further description of cap 90 can found in U.S. patent application Ser. No. 11/058,197 which is fully incorporated herein by reference.

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in the hearing aid fields as well as other fields which will be recognized by practitioners skilled in the art. For example, the inverted microphone can be used for any type of hearing device or even other acoustical devices where it is desirable to protect the microphone from contamination or damage, etc.

Elements, characteristics, or acts from one embodiment can be readily recombined or substituted with one or more elements, characteristics or acts from other embodiments to form numerous additional embodiments within the scope of the invention. Hence, the scope of the present invention is not limited to the specifics of the exemplary embodiment, but is instead limited solely by the appended claims.

What is claimed is:

1. A continuous wear hearing device adapted to be worn entirely within an ear canal of a wearer, the device comprising:

a receiver assembly sized to be positioned in the bony portion of the ear canal, the receiver assembly including a receiver for supplying acoustic signals to a tympanic membrane of the wearer;

a battery assembly including a metal-air battery and a battery vent, the battery coupled to the receiver assembly; and a microphone assembly coupled to the battery assembly, the microphone assembly including a microphone and a microphone sound port, the sound port facing a medial direction with respect to the ear canal, the orientation and position of the microphone in the ear canal configured to reduce fouling of the sound port by cerumen;

wherein the positioning of the microphone assembly defines an air cavity disposed between the microphone assembly and the battery assembly and wherein the microphone sound port and the battery vent are fluidically coupled to the air cavity.

2. The hearing device of claim 1, wherein the microphone sound port and the battery air vent are disposed in a spatially facing relationship with respect to the cavity.

3. The hearing device of claim 1, wherein the cavity is configured to reduce influx of cerumen to at least one of the battery vent or the microphone sound port.

4. The hearing device of claim 1, wherein an acoustical conductance pathway through a cavity entrance to the microphone sound port is substantially perpendicular to the longitudinal axis of the hearing device.

5. The hearing device of claim 1, wherein the cavity provides an air reservoir to meet the oxygen requirements of the battery in powering the hearing device for a selected period of operation.

6. The hearing device of claim 5, wherein the period is up to about two hours.

7. The hearing device of claim 1, wherein the battery is a zinc-air battery.

8. The hearing device of claim 1, wherein the hearing device includes a fixture for insertion or removal of the hearing device which does not substantially interfere with acoustical conduction to the sound port.

9. The hearing device of claim 8, wherein the fixture is coupled to a lateral portion of the microphone assembly or a lateral portion of a housing containing the microphone assembly.

10. The hearing device of claim 1, wherein at least one of the microphone assembly or the receiver assembly includes a tissue conformable sealing retainer configured to be seated in the bony portion of the ear canal.

11. The hearing device of claim 10, wherein the sealing retainer is coaxially positioned around the microphone assembly or the receiver assembly.

12. The hearing device of claim 10, wherein the sealing retainer is substantially ring or hemispherical shaped.

13. The hearing device of claim 1, further comprising a housing, wherein at least one of the microphone assembly or the battery assembly is at least partially contained in or coupled to the housing.

14. The hearing device of claim 13, wherein the housing includes at least one port for air access to the cavity.

15. A continuous wear hearing device adapted to be worn entirely within an ear canal of a wearer, the device comprising:

a receiver assembly sized to be positioned in the bony portion of the ear canal, the receiver assembly including a receiver for supplying acoustic signals to a tympanic membrane of the wearer;

a battery assembly including a metal-air battery and a battery vent, the battery coupled to the receiver assembly; and a microphone assembly coupled to the battery assembly, the microphone assembly including a microphone and a microphone sound port, the microphone sound port facing a medial direction with respect to the ear canal, the orientation and position of the microphone in the ear canal configured to reduce fouling of the sound port by cerumen and protect the microphone against damage from objects inserted into the ear canal.

16. The hearing device of claim 15, wherein the hearing device includes a fixture for insertion or removal of the hearing device which does not substantially interfere with acoustical conduction to the sound port.

17. The hearing device of claim 16, wherein the fixture is coupled to a lateral portion of the microphone assembly or a lateral portion of a housing containing the microphone assembly.

18. The hearing device of claim 15, wherein the microphone is configured to function as a parabolic microphone using an acoustical focusing effect of a morphology of the ear.

19. The hearing device of claim 18, where the orientation and position of the microphone in the ear canal are configured to have the microphone function as a parabolic microphone.

20. A continuous wear hearing device adapted to be worn entirely within an ear canal of a wearer, the device comprising:

a receiver assembly sized to be positioned in the bony portion of the ear canal, the receiver assembly including a receiver for supplying acoustic signals to a tympanic membrane of the wearer;

a battery assembly including a metal-air battery and a battery vent, the battery coupled to the receiver assembly; and a microphone assembly coupled to the battery assembly, the microphone assembly including a microphone and a microphone sound port;

wherein the positioning of the microphone assembly defines an air cavity disposed between the microphone assembly and the battery assembly and wherein the microphone sound port and the battery vent are fluidically coupled to the air cavity.

21. The hearing device of claim 20, wherein the microphone sound port and the battery air vent are disposed in a spatially facing relationship with respect to the cavity.

22. The hearing device of claim 20, wherein the microphone sound port faces a medial direction with respect to the ear canal, the orientation and position of the microphone in the ear canal configured to reduce fouling of the sound port by cerumen.

23. The hearing device of claim 20, wherein the cavity provides an air reservoir to meet the oxygen requirements of the battery in powering the hearing device for a selected period of operation.

24. The hearing device of claim 23, wherein the period is up to about two hours.

* * * * *